US007612309B2

(12) United States Patent
Chung et al.

(10) Patent No.: US 7,612,309 B2
(45) Date of Patent: Nov. 3, 2009

(54) BUFFERING MECHANISM FOR GAS CIRCUIT BREAKER

(75) Inventors: Chang-Ching Chung, Taipei County (TW); Ming-Sheng Huang, Taipei County (TW)

(73) Assignee: Chung-Hsin Electric & Machinery Mfg. Corp., Taoyuan Hsien ( * ) Notice: Subject to any disclaimer, the term of this patent is extended or adjusted under 35 U.S.C. 154(b) by 3 days.

(21) Appl. No.: 11/984,854

(22) Filed: Nov. 23, 2007

(65) Prior Publication Data

US 2009/0134124 A1 May 28, 2009

(51) Int. Cl.
*H01H 33/70* (2006.01)
*H01H 9/30* (2006.01)
*H01H 33/04* (2006.01)

(52) U.S. Cl. ..... 218/84; 218/78

(58) Field of Classification Search ..... 218/78, 218/84

See application file for complete search history.

(56) References Cited

U.S. PATENT DOCUMENTS 2,874,242 A * 2/1959 Kurtz ..... 200/82 B
2,911,546 A * 11/1959 Oppel ..... 361/9
3,076,081 A * 1/1963 Oppel ..... 200/308
4,513,187 A * 4/1985 Schaad et al. ..... 218/143
5,604,340 A * 2/1997 Yamada et al. ..... 218/143
5,668,360 A * 9/1997 Perret et al. ..... 218/5

* cited by examiner

*Primary Examiner*—Elvin G Enad
*Assistant Examiner*—Alexander Talpalatskiy

(57) ABSTRACT

A buffering mechanism for a gas circuit breaker includes a center piece which includes two protrusions extending from two ends thereof and two match surfaces are defined in two opposite sides of the center piece. Two side boards each have a pivot hole and a slot defined therethrough, the two protrusions of each end of the center piece are pivotably engaged with the pivot hole and the slot respectively. A plurality of impact plates are engaged with the two match surfaces of the center piece. When the impact plates are hit by the two links of the Y-shaped link mechanism of the gas circuit breaker at different times, the center piece is pivoted along the slots to absorb impact forces from the two links.

5 Claims, 6 Drawing Sheets

BUFFERING MECHANISM FOR GAS CIRCUIT BREAKER

BACKGROUND OF THE INVENTION (1) Field of the Invention

The present invention relates to a buffering mechanism for gas circuit breaker and the buffering mechanism reduces impact to the center piece thereof.

(2) Description of the Prior Art

A conventional gas circuit breaker for protecting circuit system generally includes an activation mechanism which allows the circuit to be shut off at high speed. In order to reduce over stroke of the activation mechanism due to initial movement, an impact unit 5 as shown in FIG. 6 is used between the two links of the activation mechanism. The two links of the activation mechanism move toward the impact unit 5 and hit the impact unit 5 when shutting the circuit off. However, due to friction, the two links actually hit the impact unit at different time. The impact unit 5 usually is welded to a fixed object and cannot move so that the impact from the two links can damage the impact unit 5.

The present invention intends to provide a buffering mechanism for the gas circuit breaker and the center piece is pivotably connected between two side boards so as to absorb impact of the two links which hit the center piece at different times.

SUMMARY OF THE INVENTION

The present invention relates to a buffering mechanism for a gas circuit breaker and the buffering mechanism comprises a center piece having two protrusions extending from two ends thereof and two match surfaces are defined in two opposite sides of the center piece. Two side boards each have a pivot hole and a slot, and the two protrusions of each end of the center piece are pivotably engaged with the pivot hole and the slot respectively, wherein the slot is sized to allow the protrusion to move therein. A plurality of impact plates are engaged with the two match surfaces of the center piece.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
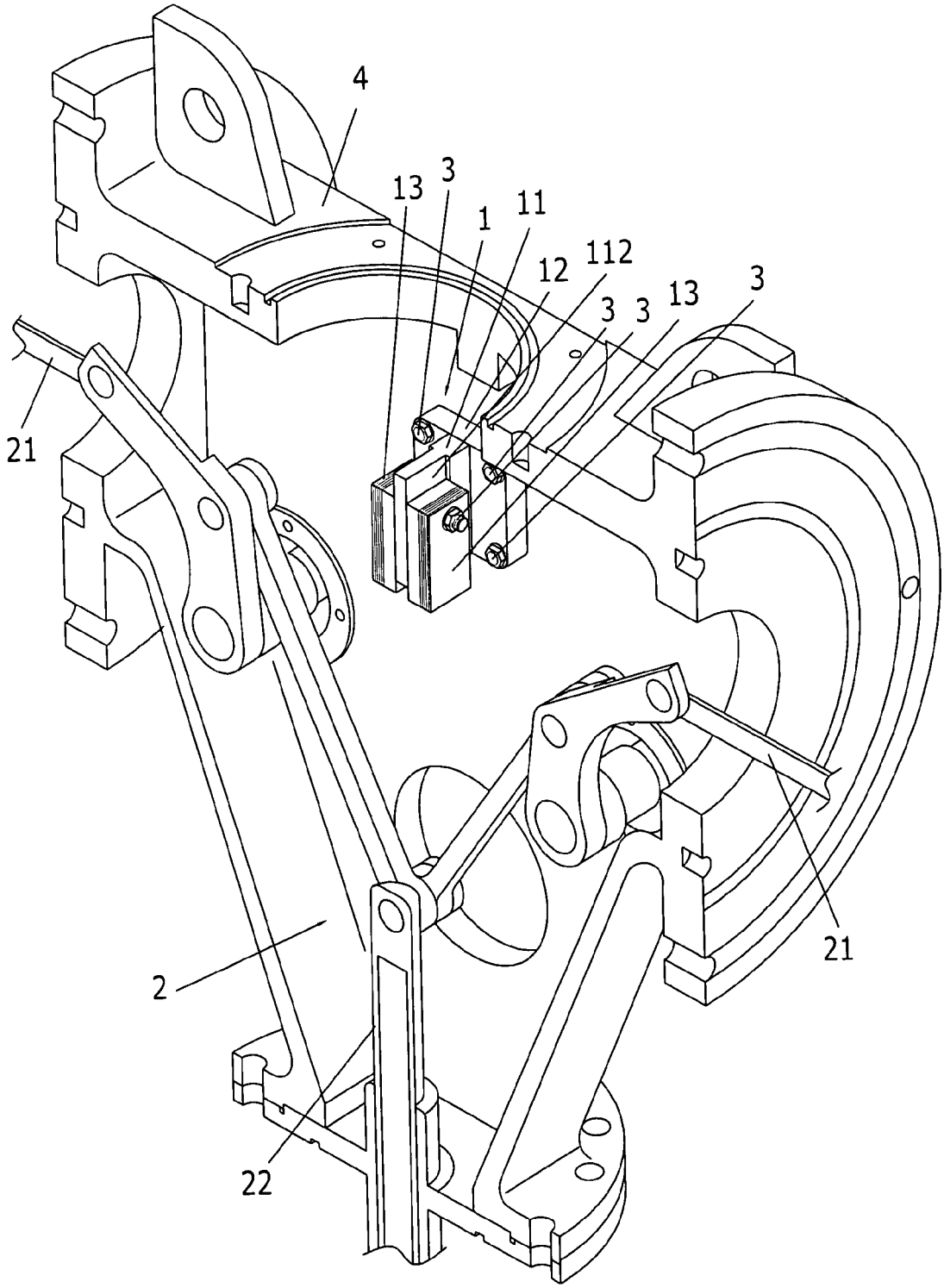
FIG. 1 is a perspective view of the buffering mechanism of the present invention in the gas circuit breaker.
Figure 2:
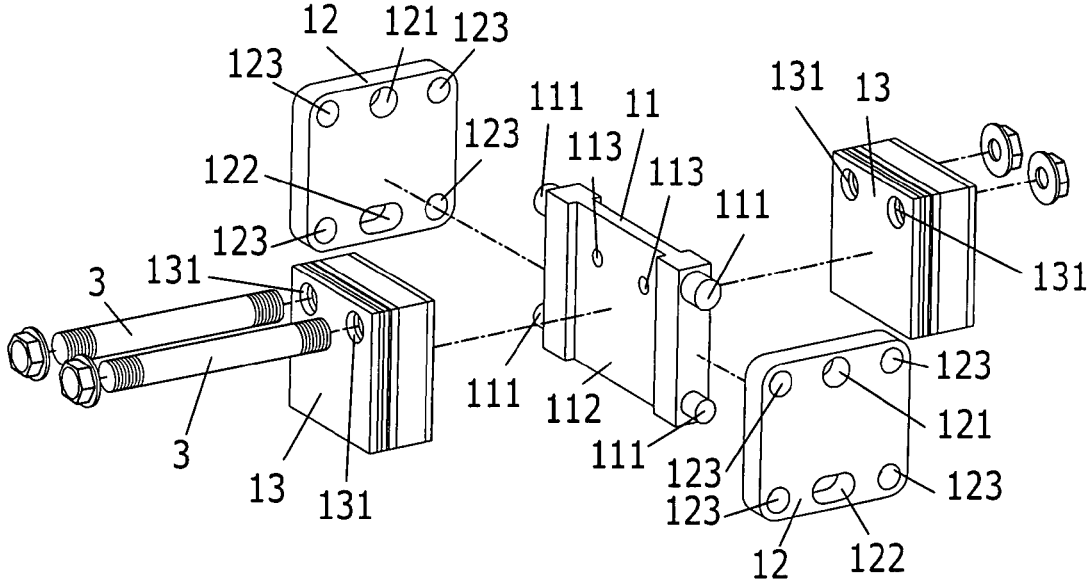
FIG. 2 is an exploded view to show the buffering mechanism of the present invention.
Figure 3:
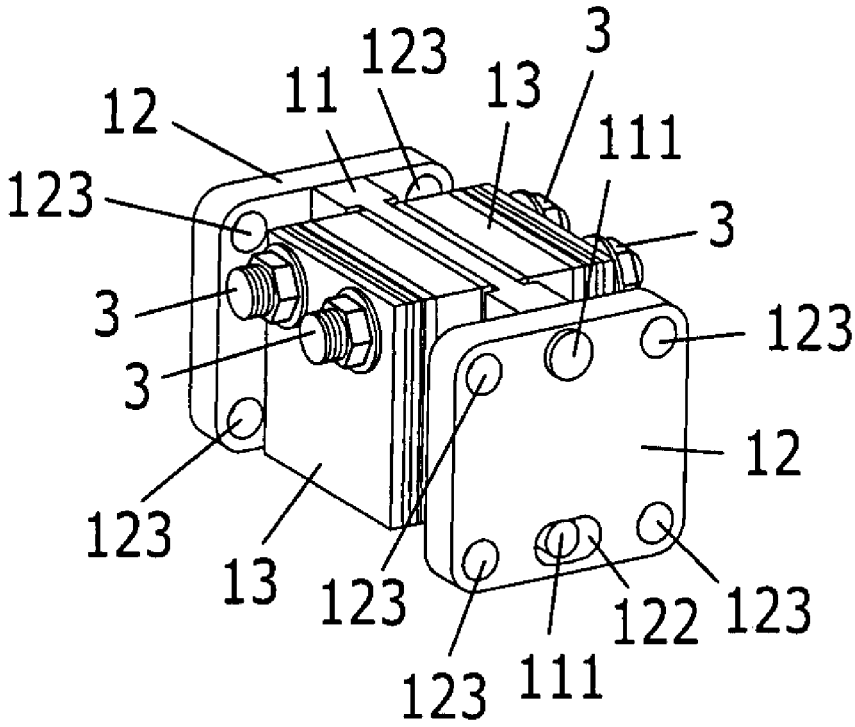
FIG. 3 is a perspective view to show the buffering mechanism of the present invention.
Figure 4:
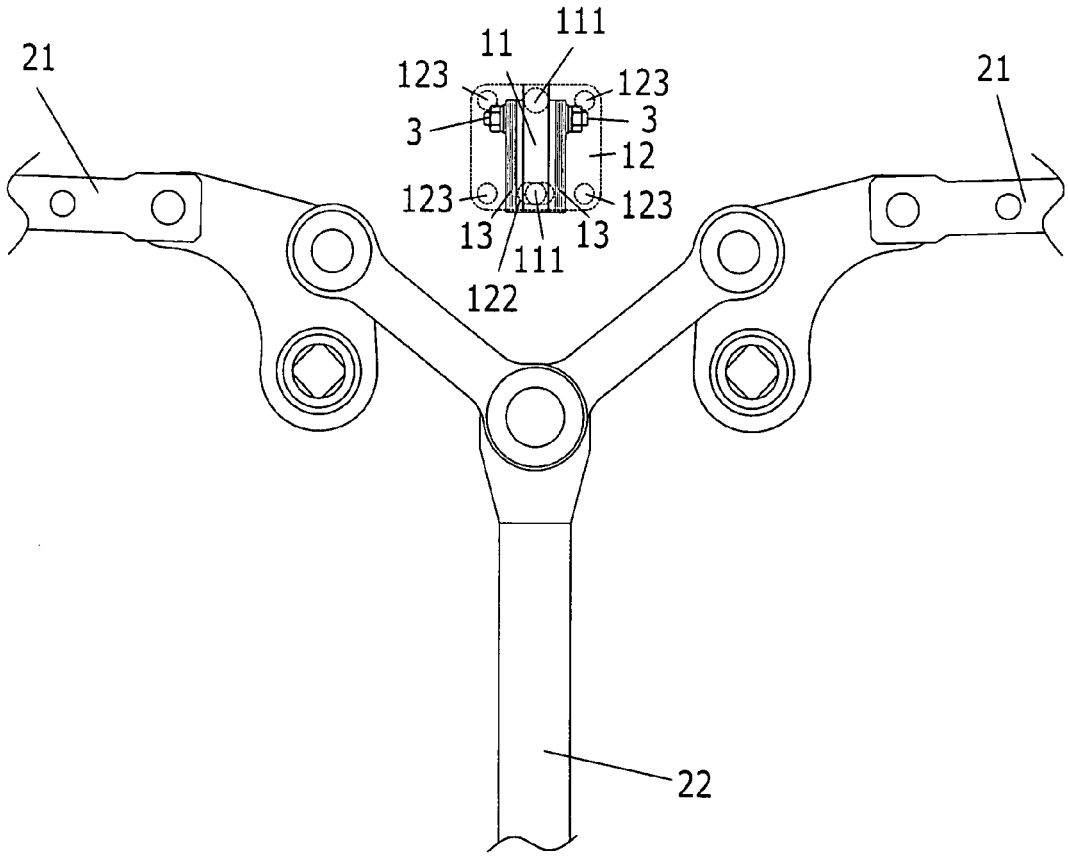
FIG. 4 shows that the buffering mechanism of the present invention is located between two links of the gas circuit breaker.

Referring to FIGS. 1 to 4, the buffering mechanism 1 for gas circuit breaker of the present invention comprises a center piece 11 having two protrusions 111 extending from each of two ends thereof and two match surfaces 112 are defined in two opposite sides of the center piece 11. Two through holes 113 are defined through the two respective match surfaces 112.

Two side boards 12 each have a pivot hole 121 and a slot 122 defined therethrough, the two protrusions 111 of each end of the center piece 11 are pivotably engaged with the pivot hole 121 and the slot 122 respectively. Each slot 122 is sized such that the protrusion 111 is movable therein. Each side board 12 further includes a plurality of holes 123 for positioning the side boards 12 which clamp the center piece 11 therebetween. In this embodiment, the slot 122 of each side board 12 is an oval slot and includes the curvature of 10 degrees.

A plurality of impact plates 13 are engaged with the two match surfaces 112 of the center piece 11. Each impact plate 13 includes passages 131 which are located in alignment with the through holes 113 in the center piece 11 so that bolts 3 extend through the passages 131 of the impact plates 13 and the through holes 113 of the center piece 11, and are connected with two nuts.

Figure 5:
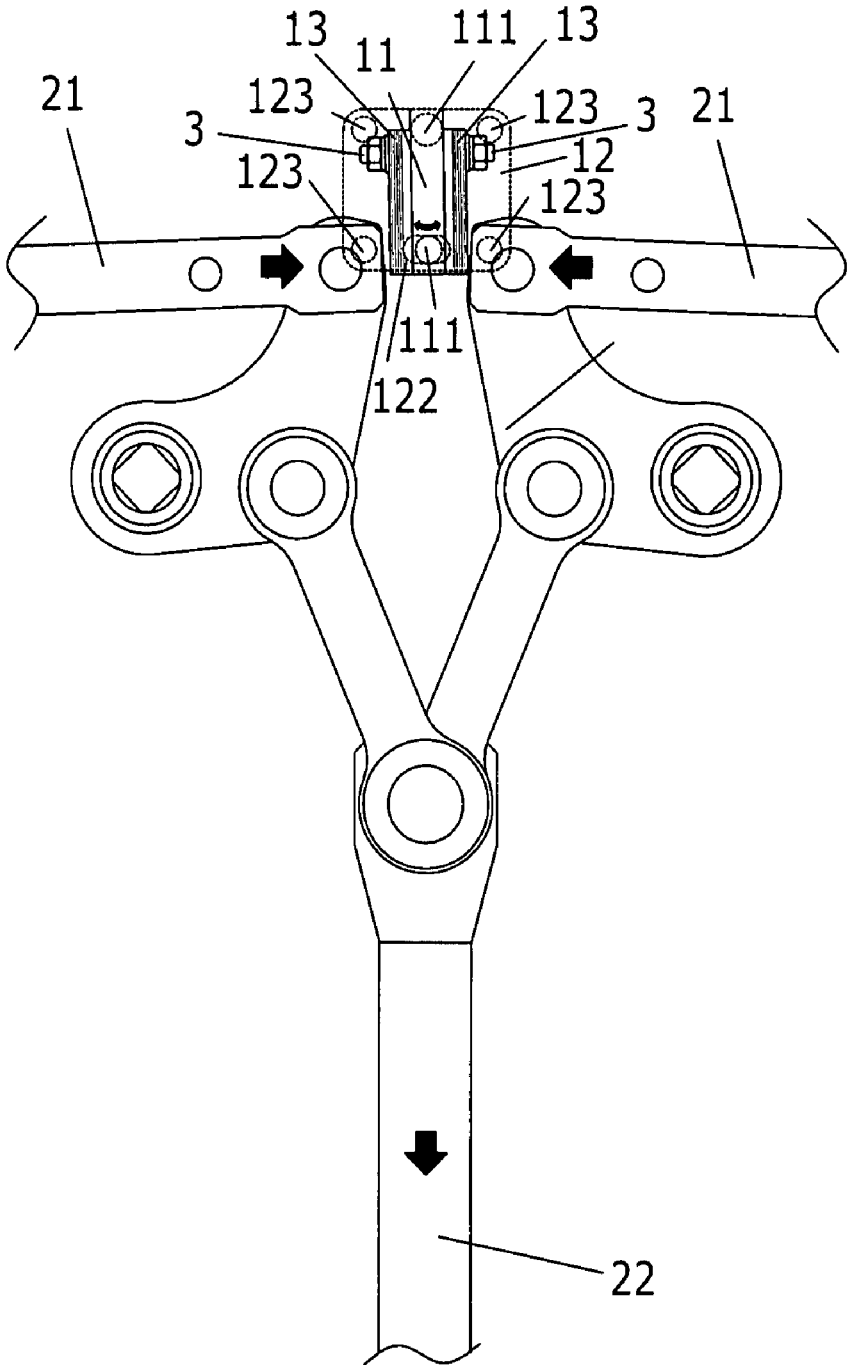
FIG. 5 shows the two links are moved to hit the buffering mechanism of the present invention.
Figure 6:
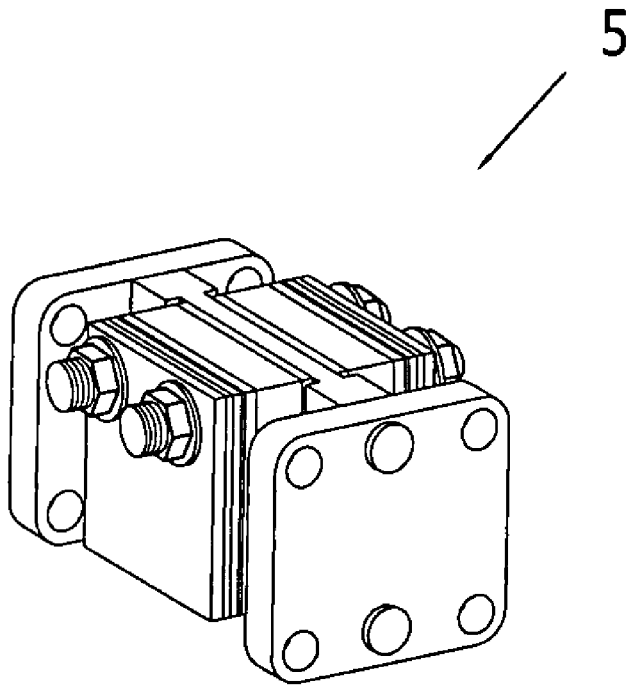
FIG. 6 shows a conventional impact unit of a gas circuit breaker.

The gas circuit breaker includes a barrel 4 and a Y-shaped link mechanism 22 is located in the barrel 4 and cooperated with in two links 21. The Y-shaped link mechanism 22 includes an upright member and two inclined members which are pivotably connected to a top of the upright member. The two links 21 are pivotably connected to the two inclined members respectively. As shown in FIG. 5, when the upright member of the Y-shaped link mechanism 22 is moved downward, the two inclined members pull the two links 21 to move toward the buffering mechanism 1. One of the links 21 hits the impact plates 13 first and the force pivots the center piece 11 about the protrusions 111 engaged with the pivot holes 121 of the side boards 12. The movement of the center piece 11 absorb the impact. The other link 21 then hits the impact plates 13 one the other side of the center piece 11 and the center piece 11 pivots again. By this buffering mechanism 1, the center piece 11 is avoided from being broken and damaged.

While we have shown and described the embodiment in accordance with the present invention, it should be clear to those skilled in the art that further embodiments may be made without departing from the scope of the present invention.

What is claimed is:

1. A gas circuit breaker comprising: a barrel; a Y-shaped link mechanism located in the barrel and cooperated with two links, the Y-shaped link mechanism including an upright member and two inclined members which are pivotably connected to a top of the upright member, the two links pivotably connected to the two inclined members respectively; a buffering mechanism located inside the gas circuit breaker and including a center piece having two protrusions extending from each of two ends thereof and two match surfaces defined in two opposite sides thereof;

two side boards each having a pivot hole and a slot defined therethrough, the two protrusions of each end of the center piece pivotably engaged with the pivot hole and the slot respectively, each slot being sized such that the protrusion is movable therein, and a plurality of impact plates engaged with the two match surfaces of the center piece wherein the Y-shaped link mechanism engages with the impact plates.

2. The gas circuit breaker as claimed in claim 1, wherein the center piece includes two through holes defined through the two respective match surfaces and each impact plate includes two passages which are located in alignment with the through holes in the center piece, two bolts extending through the through holes and the passages and are connected with two nuts.

3. The gas circuit breaker as claimed in claim 1, wherein each side board includes a plurality of holes for positioning the side boards.

4. The gas circuit breaker as claimed in claim 1, wherein the slot of each side board is an oval slot.

5. The gas circuit breaker as claimed in claim 1, wherein the slot of each side board is a curved slot and the curvature is 10 degrees.

* * * * *